US006830022B2

(12) United States Patent
Lutz

(10) Patent No.: US 6,830,022 B2
(45) Date of Patent: Dec. 14, 2004

(54) VALVE ACTUATION LINKAGE MECHANISM

(75) Inventor: Brian Lutz, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 93 days.

(21) Appl. No.: 10/016,563

(22) Filed: Oct. 30, 2001

(65) Prior Publication Data

US 2003/0079705 A1 May 1, 2003

(51) Int. Cl.[7] ..... F01L 1/18

(52) U.S. Cl. ..... 123/90.39; 123/90.4; 123/90.41; 74/559

(58) Field of Search ..... 123/90.39, 90.4, 123/90.41, 90.42; 29/888.2; 74/559

(56) References Cited

U.S. PATENT DOCUMENTS 1,438,937 A * 12/1922 Arnold ..... 123/73 AB
4,850,315 A * 7/1989 Mallas ..... 123/90.61
4,856,468 A * 8/1989 Speil et al. ..... 123/90.47
5,632,237 A * 5/1997 Cornell et al. ..... 123/90.46
5,706,771 A * 1/1998 Van Heyningen et al. ..... 123/90.46
6,138,626 A * 10/2000 Speil ..... 123/90.39
6,273,042 B1 * 8/2001 Perez et al. ..... 123/90.39
6,397,805 B1 * 6/2002 Knickerbocker ..... 123/90.39
6,463,898 B1 * 10/2002 Yates ..... 123/90.39
6,484,682 B2 * 11/2002 Danesh et al. ..... 123/90.39
6,484,683 B2 * 11/2002 Zielke ..... 123/193.5

* cited by examiner

*Primary Examiner*—Thomas Denion
*Assistant Examiner*—Ching Chang
(74) *Attorney, Agent, or Firm*—Susan L. Lukasik; Dennis Kelly Sullivan; Jeffrey P. Calfa

(57) ABSTRACT

There is provided a valve actuation linkage mechanism for use in an internal combustion engine that reduces friction wear on the valve assembly during engine operation and can be pre-assembled to reduce manufacturing time and costs. The valve actuation linkage mechanism comprises a rocker arm having a pivot rod cup, a pivot rod, a valve bridge having a pivot rod chamber, and a pivot rod retainer. The pivot rod comprises a pivot rod head, a pivot rod neck, a pivot rod body, and a pivot rod bottom. The valve bridge comprises a middle valve bridge section having the pivot rod chamber and a pair of pivot rod retainer securing bore, a bottom valve bridge section, and a lubricant dimple in the pivot rod chamber. The pivot rod retainer is comprised of a pivot rod orifice having pivot rod prongs and at least one securing orifice.

20 Claims, 7 Drawing Sheets

VALVE ACTUATION LINKAGE MECHANISM

FIELD OF THE INVENTION

This invention relates generally to valve trains in internal combustion engines. More particularly, this invention relates to valve actuation mechanisms using rocker arms and valve bridges to actuate intake and exhaust valves in a diesel engine.

BACKGROUND OF THE INVENTION

Internal combustion engines typically have rocker arms to actuate intake and exhaust valves, which permit air to enter and exit each cylinder. Commonly there are separate rocker arms to actuate a valve or pair of valves. Push rods cause the rocker arms to rotate or pivot and thereby actuate the valves. The push rods extend through the engine to connect to a camshaft. As the camshaft rotates, the push rods move the rocker arms to open and close the valves. The camshaft is designed to open and close the valves in conjunction with the cycling of the piston in the cylinder.

Recent valve actuation mechanism designs use rocker carriers and rocker arm assemblies with rocker arms made of plate material. For example, those disclosed in patent application Ser. No. 09/768,520 filed on Jan. 24, 2001, by Martin Zielke for a Rocker Carrier, and Ser. No. 09/769,610 filed on Jan. 25, 2001 by Danesh et al. for a Rocker Arm Assembly, which are hereby incorporated by reference. These patent applications are both assigned to the assignee of the present patent application, International Truck and Engine Corporation. The recent designs though improved over earlier designs have some drawbacks.

FIG. 1 illustrates a perspective view of a partial prior art valve actuation mechanism. There is shown a valve actuation linkage mechanism 100 generally comprising a valve bridge 10, a pivot foot 20, a pivot foot fastener 30 and a rocker arm 40.

FIG. 2 shows how the partial valve actuation mechanism of FIG. 1, without the valve bridge, mounted on a rocker carrier 200 which will be mounted on a cylinder head (not shown) in an internal combustion engine. The rocker arms 40 and 240 are cooperatively mounted on the rocker carrier 200 through a corresponding rocker arm pedestal or fulcrum plate 220 and fastened to the rocker carrier 200 by hold down bolts 210. The hold down bolts 210 allow the rocker arms 40 and rocker arm fulcrum plate 220 to be pre-installed to the rocker carrier 200 thereby decreasing engine manufacturing time and costs. The rocker carrier 200 shown would be mounted on one side or bank of a V-8 type engine. The rockers arms 40 and 240 shown in FIG. 2 typically have the same configuration but differ in size. FIG. 2 shows the exhaust rocker arm 40 longer and larger than the intake rocker arm 240. However, length and size of the rocker arms 40 and 240 is determined by the location of the intake and exhaust valves in relation to the rocker arm assembly. The rocker arms could be the same or different sizes depending on a particular engine application.

Referring again to FIG. 1, the valve actuation linkage mechanism 100 could be used in an engine application having four valves per cylinder. The valve bridge 10 when actuated by the rocker arm 40 via the pivot foot 25 will act on a pair of valves, e.g., a pair of intake or exhaust valves (not shown). The rocker arm generally comprises a push rod cup 60, a pivot ball cup 70, a rocker arm aperture 80, and a pivot foot end 55 having a pivot foot cup 50. The pivot foot cup 50 accepts a pivot foot 20 secured by a pivot foot fastener 30. The pivot foot fastener 30 secures the pivot foot 20 to the pivot foot cup 50 via a set of opposing pivot foot clamps 37 which are clamp or crimped on to the exterior surface of the pivot foot cup 50.

During engine operation, a push rod (not shown) actuates the rocker arm 40 via the push rod cup 60. The rocker arm 40 will pivot via a gage or pivot ball (not shown) in the pivot ball cup 70. The pivot foot 20 will in turn actuate the valves (not shown) via the Valve Bridge 10. The pivot foot 20 contacts and acts on the valve bridge 10 to actuate valve movement (not shown) in a particular cylinder. In particular, the pivot foot bottom 25 contacts the valve bridge 10 at a top bridge contact surface area 15 to actuate valve movement. The physical makeup and positioning of the valve actuation linkage mechanism 100 is such that the of the pivot foot bottom 25 is continuously sitting on or contacting the valve bridge 10 top contact surface area 15. In this manner, rocker arm 40 movement and force is immediately translated, via the pivot foot 20, to the valve bridge 10.

As the rocker arm 40 moves and pivots during engine operation, the attached pivot foot pivot travels or cycles upward or downward in an arc motion. The pivot foot's 25 arcing motion and simultaneous mechanical contact on the valve bridge 10 results in friction wear between the pivot foot 20 and the bridge contact area 15. In essence, the pivot foot bottom surface 25 travels on the bridge contact area 15 and exerts a force with both vertical 13 and horizontal 17 elements. As the rocker arm 40 pivots during engine operation, the pivot foot bottom surface 25 exerts both a vertical force 13 and a back and forth horizontal force 17. The mechanical action between the pivot foot 20 and the valve bridge 10 results in excessive friction wear between the pivot foot contact surface 27 and the bridge contact area 15. Additionally, the pivot foot fastener 30 encounters vertical 13 and horizontal 17 forces. This degrades and loosens the connection securing the pivot foot 20 to the rocker arm 40 pivot foot cup 50. Moreover, the physical orientation and configuration of the rocker arm 40, pivot foot 20, pivot foot fastener 30 and valve bridge 10 prevent adequate oil lubrication of these interconnected and interactive parts, adding to the friction wear drawback of this design.

Thus, existing valve actuation linkage mechanisms suffer from excessive wear between the pivot foot and valve bridge at the point of contact or contact area. Accordingly, there is a need for a valve actuation linkage mechanism that can be pre-assembled and that reduces friction wear on the valve assembly during operation.

SUMMARY OF THE INVENTION

The present invention provides a valve actuation linkage mechanism for use in an internal combustion engine that reduces friction wear on the valve assembly during engine operation and can be pre-assembled resulting in decreased manufacturing time and cost. The valve actuation linkage mechanism comprises a rocker arm having a pivot rod cup, a pivot rod, a valve bridge having a pivot rod chamber, and a pivot rod retainer. The pivot rod comprises a pivot rod head, a pivot rod neck, a pivot rod body, and a pivot rod bottom. The valve bridge comprises a middle valve bridge section having the pivot rod chamber and at least one adjacent pivot rod retainer securing bore, a bottom valve bridge section, and a lubricant dimple in the pivot rod chamber. The pivot rod retainer is comprised of a pivot rod orifice having at least one pivot rod prong and at least one securing orifice.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which.

DESCRIPTION OF THE INVENTION

Figure 3:
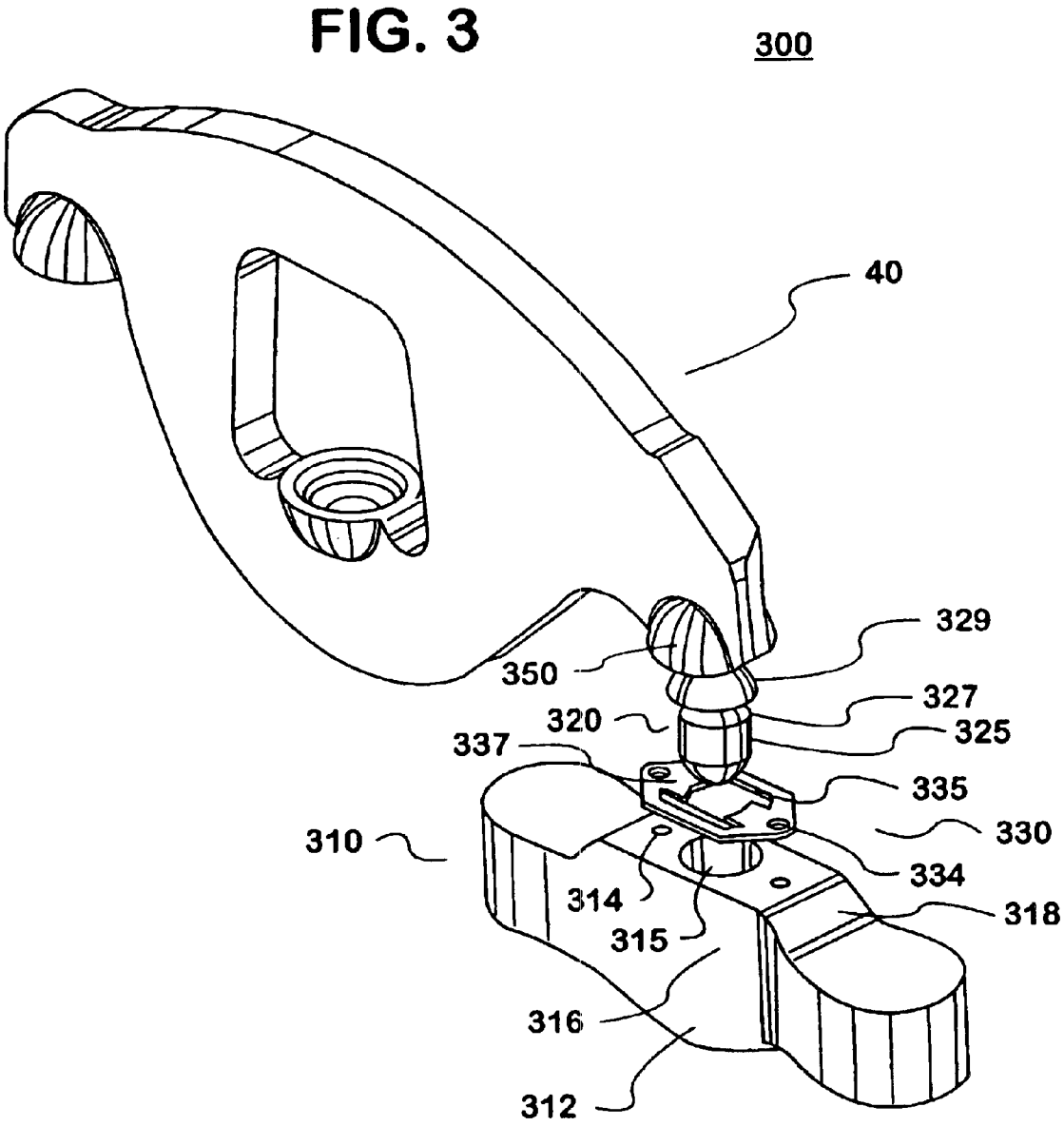
FIG. 3 shows a perspective view of an embodiment of a valve actuation linkage mechanism according to the present invention.

FIG. 3 illustrates a perspective view of a preferred embodiment of a valve actuation linkage mechanism 300 according to the present invention. The valve actuation linkage mechanism 300 comprises a valve bridge 310, a pivot rod 320, a pivot rod retainer 330 and a rocker arm 40. The valve actuation linkage mechanism 300 depicted in FIG. 3 is preferably used in a 4-valve per cylinder engine application. Those of skill in the art will readily recognize that other engine applications are possible.

Figure 1:
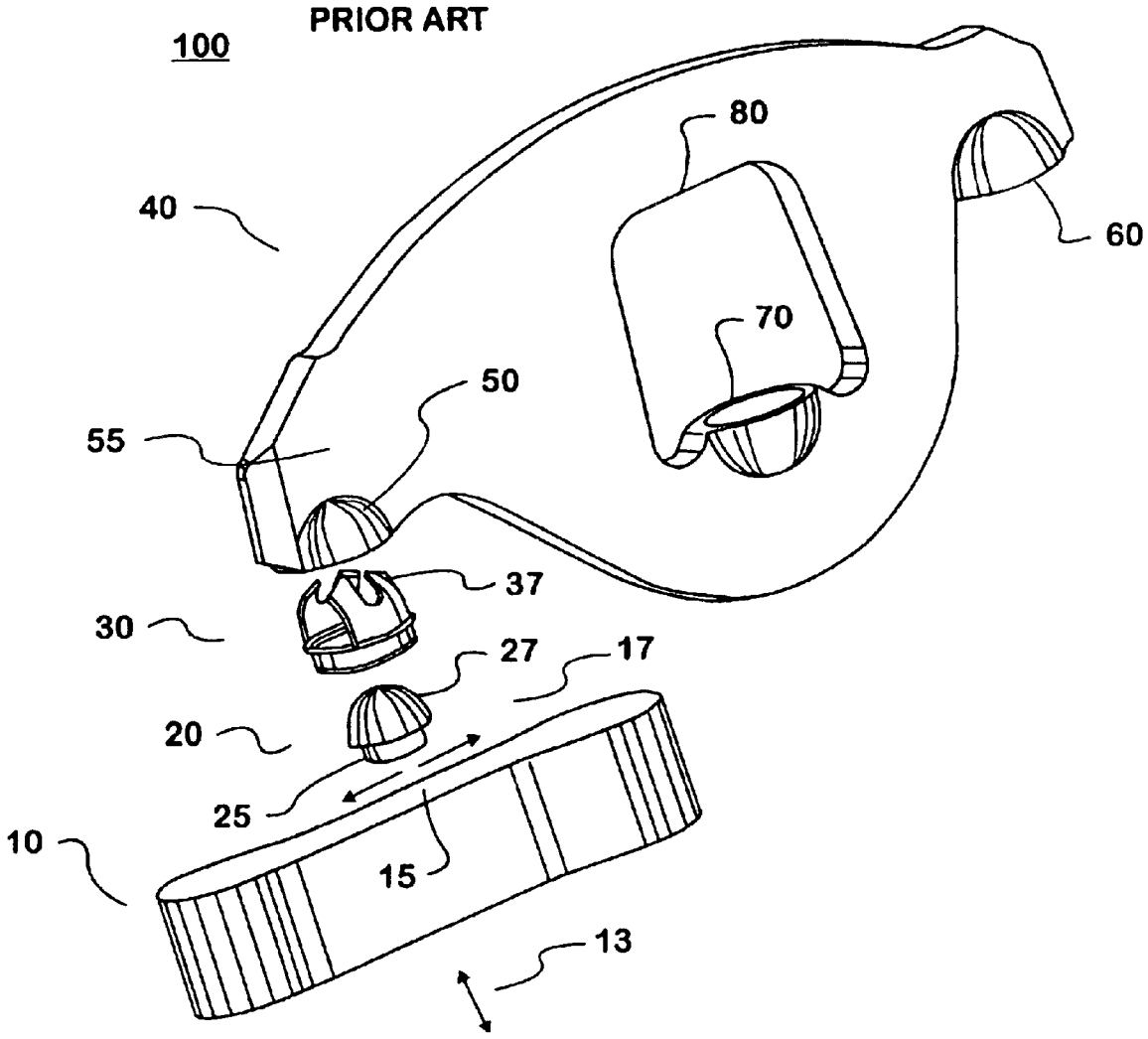
FIG. 1 PRIOR ART
FIG. 1 shows a perspective view of a prior art valve actuation assembly.
Figure 2:
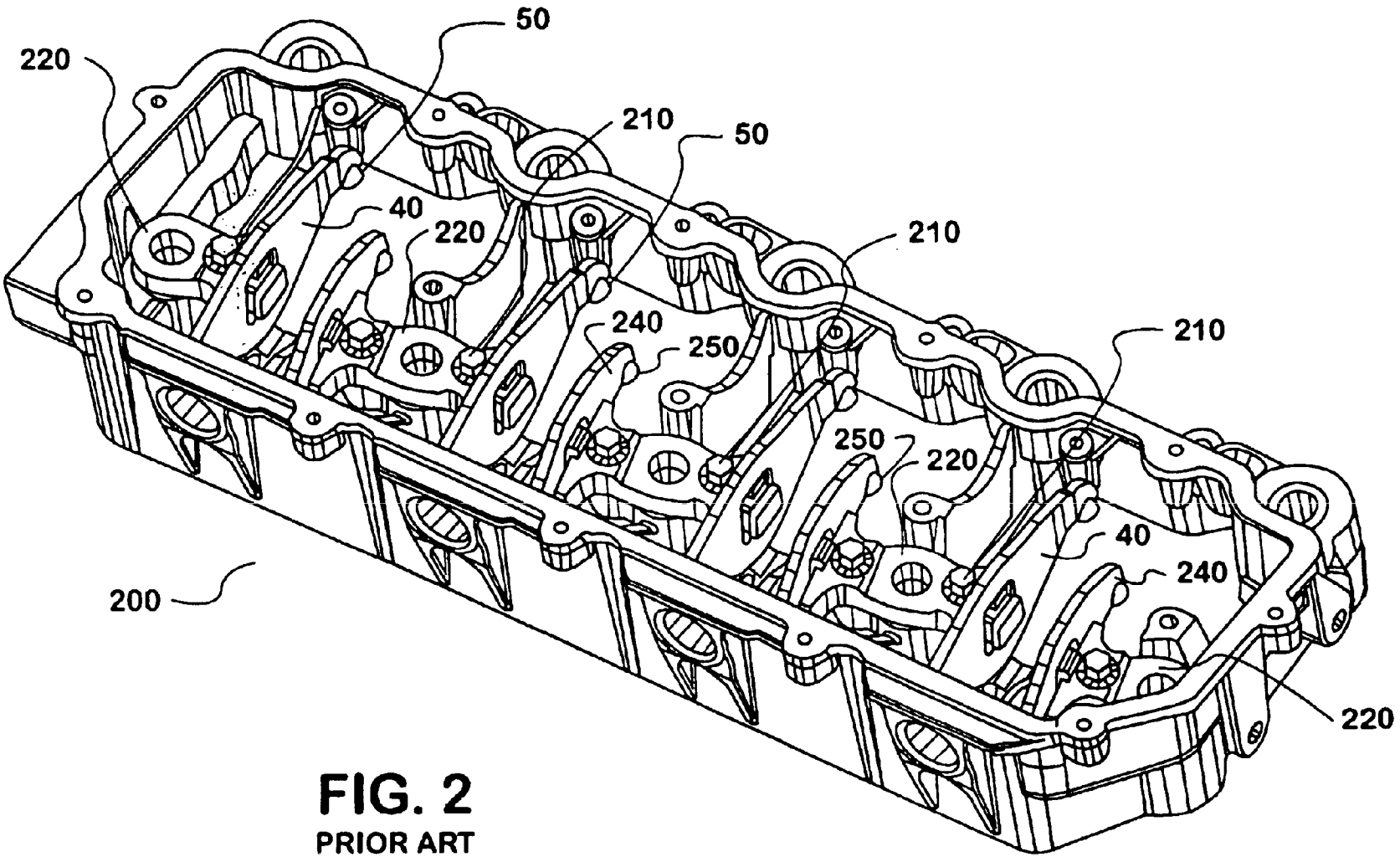
FIG. 2 PRIOR ART
FIG. 2 shows a perspective view of the prior art valve actuation linkage mechanism of FIG. 1 installed on a rocker carrier.

The rocker arm 40 of the valve actuation linkage mechanism 300 shown in FIG. 3 retains substantially the same function and physical configuration as existing prior art rocker arms 40 (shown in FIG. 1). The rocker arm 40 will cooperate with the pivot rod 320 in the valve actuation linkage mechanism 300 to actuate the valve bridge 310. The novel pivot foot preferably comprises a pivot rod head 329, a pivot rod neck 327, and a pivot rod body 325 with a pivot rod bottom 425 (shown in FIG. 4). The pivot rod head 329 preferably has a curved shape in the form of a "mushroom" head. In this manner, the pivot rod head 329 will complimentarily cooperate with a pivot rod cup 350 in the rocker arm 40. The complimentary shapes of the curved pivot rod head 329 and the pivot rod cup 350 allow for easier motion between the two parts and tend to reduce wear between them as the valve actuation linkage mechanism 300 operates.

FIG. 3 also illustrates a novel valve bridge 310 that will act simultaneously on a pair of intake or exhaust valves (not shown). The valve bridge in this embodiment, the valve bridge 310 preferably comprises a pivot rod chamber 315, a pair of fastener bores 314, valve stem chambers 405 (shown in FIG. 4), a bottom valve bridge section 312 and a middle valve bridge section 316. The pivot rod chamber 315 is preferably configured to be a hollow cylindrical void or chamber with a complimentary pivot rod body 325 configuration that allows insertion of the pivot rod 320. Significantly, the configuration of the pivot rod bottom 425 and corresponding pivot rod chamber bottom 415 (shown in FIG. 4) in the valve bridge 310 will eliminate the flat surface rubbing contact 15 present in prior designs thereby substantially reducing friction wear between linkage mechanism 300 components, particularly between the pivot foot bottom 25 and the valve bridge contact surface area 15 (shown in FIG. 1). Additionally, the pivot rod chamber 315 is preferably configured such that there Is a divot or dimple 417 (shown in FIG. 4) at the pivot chamber bottom 415. The pivot or dimple 417 will preferably hold engine oil or some other lubricant to provide lubrication between the pivot rod 320 and the valve bridge 310. In particular, lubrication between the pivot rod bottom 425 and the pivot chamber bottom 415 (shown in FIG. 4), thereby substantially reducing friction wear between the pivot rod 320 and the valve bridge 310.

The pivot rod chamber 315 is preferably located in the middle valve bridge section 316 and can be cast as part of or drilled into the valve bridge 310. The middle valve bridge section 316 can be either a raised body portion as shown here in FIG. 3 or flush as illustrated in FIG. 1 depending on the engine application. The bottom valve bridge section 312 is preferably a raised body portion that extends away and downward from the valve bridge 310. The bottom valve bridge section 312 is preferable since it will provide the valve bridge 310 with added structural support and strength, as there is now a pivot rod chamber 315 in the valve bridge 310. The actual configuration of the bottom valve bridge section 312 will be determined by the particular engine application used. Also, the fastener bores 314 are typically bored into the valve bridge 310 adjacent to the pivot rod chamber 315. The fastener bores 314 allow the pivot rod 310 to be secured in the pivot rod chamber 315 via the pivot rod retainer 330 (shown in FIGS. 6 & 7).

The pivot rod retainer 330 is preferably flat and comprises a pivot rod retaining area 335, a pair of pivot rod retaining prongs 337, and a pair of opposing fastener orifices 334. The pivot rod retainer 330 will have a thickness, length and width that will be dependent on the particular engine application where it 330 is to be used. The pivot rod retaining prongs 337 are preferably situated in opposing positions in the pivot rod retaining area 335 adjacent to the fastener orifices 334. The pivot rod 320 can be preferably inserted into the pivot rod retainer 320 either before or after the pivot rod retainer is secured to the valve bridge 310. The pivot rod retaining area 335 is configured in a manner so that the pivot rod 320, once inserted, can move as necessary as the rocker arm 40 goes through its motion during engine operation. The novel pivot rod retainer 330 and the valve bridge 310 have moved the previous prior retaining or securing location of the pivot foot 20 from the rocker arm 40 pivot foot cup 50 to the valve bridge 310.

In a first case, the pivot rod 320 is inserted into the pivot rod retainer 330 before the retainer 330 is fastened to the valve bridge 310. The pivot rod body 325 is inserted into and travels in the pivot rod retaining area 335. The retaining prongs 337 are resilient and flex or move to allow the pivot rod body 325 to travel in pivot rod retaining area 335. Once the pivot rod body 325 has traveled sufficiently, the retaining prongs 337 will resiliently rebound or flex to secure the pivot rod retainer 330 to the pivot rod 320 around the pivot rod neck 327. The connected pivot rod 320 and pivot rod retainer 330 tandem would now be fastened to the valve bridge 310 (shown in FIGS. 6 & 7). The pivot rod 320 is inserted into the pivot rod chamber 315 of the valve bridge 310. The retainer 330/pivot rod 320 combination is then preferably secured to the valve bridge by using a pair of valve bridge fasters 614 (shown in FIGS. 6 & 7), e.g., drill screws or rivets.

Figure 6:
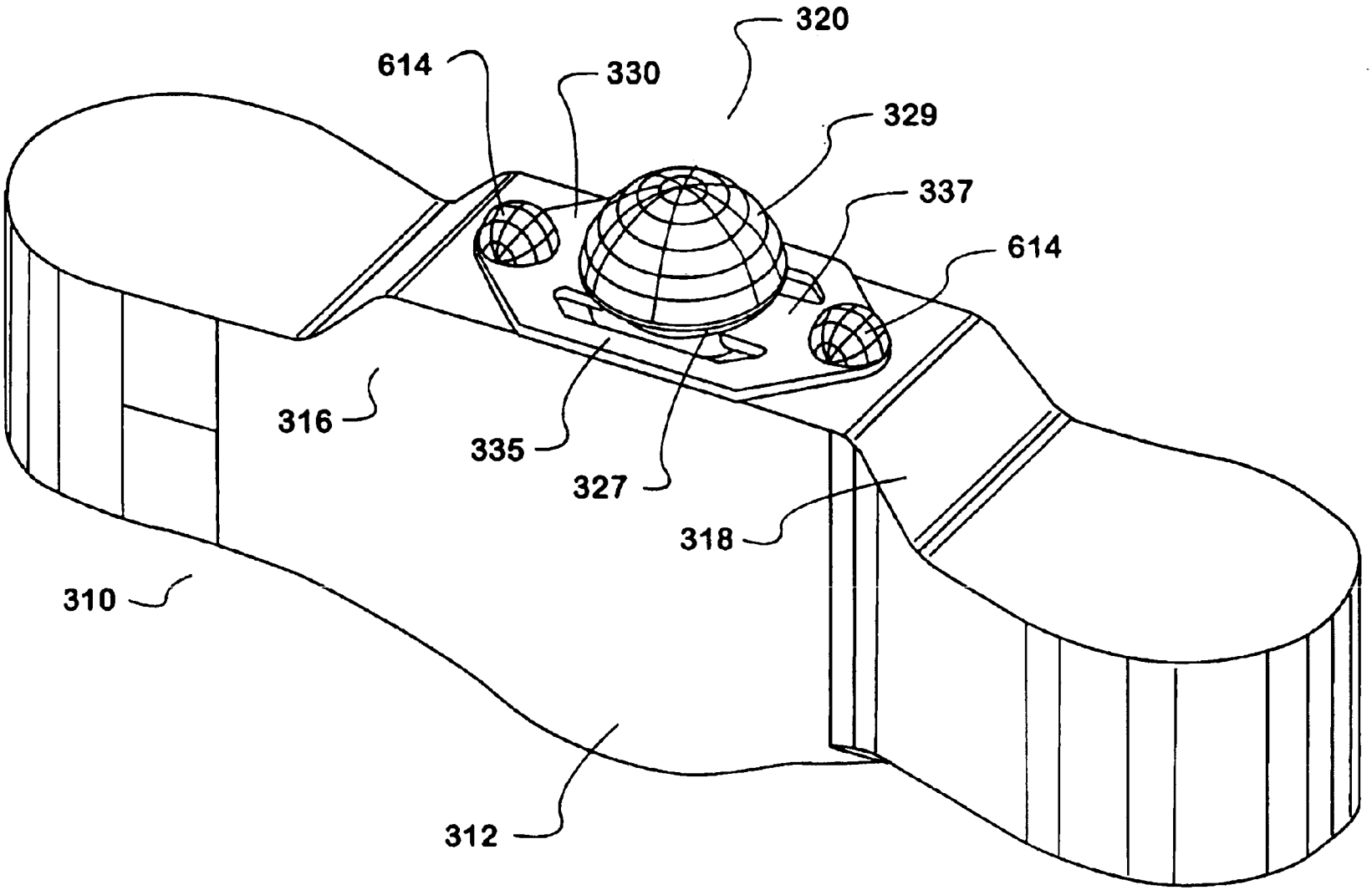
FIG. 6 shows a perspective view of a pivot rod and valve bridge of the valve actuation linkage mechanism of FIG. 3.
Figure 7:
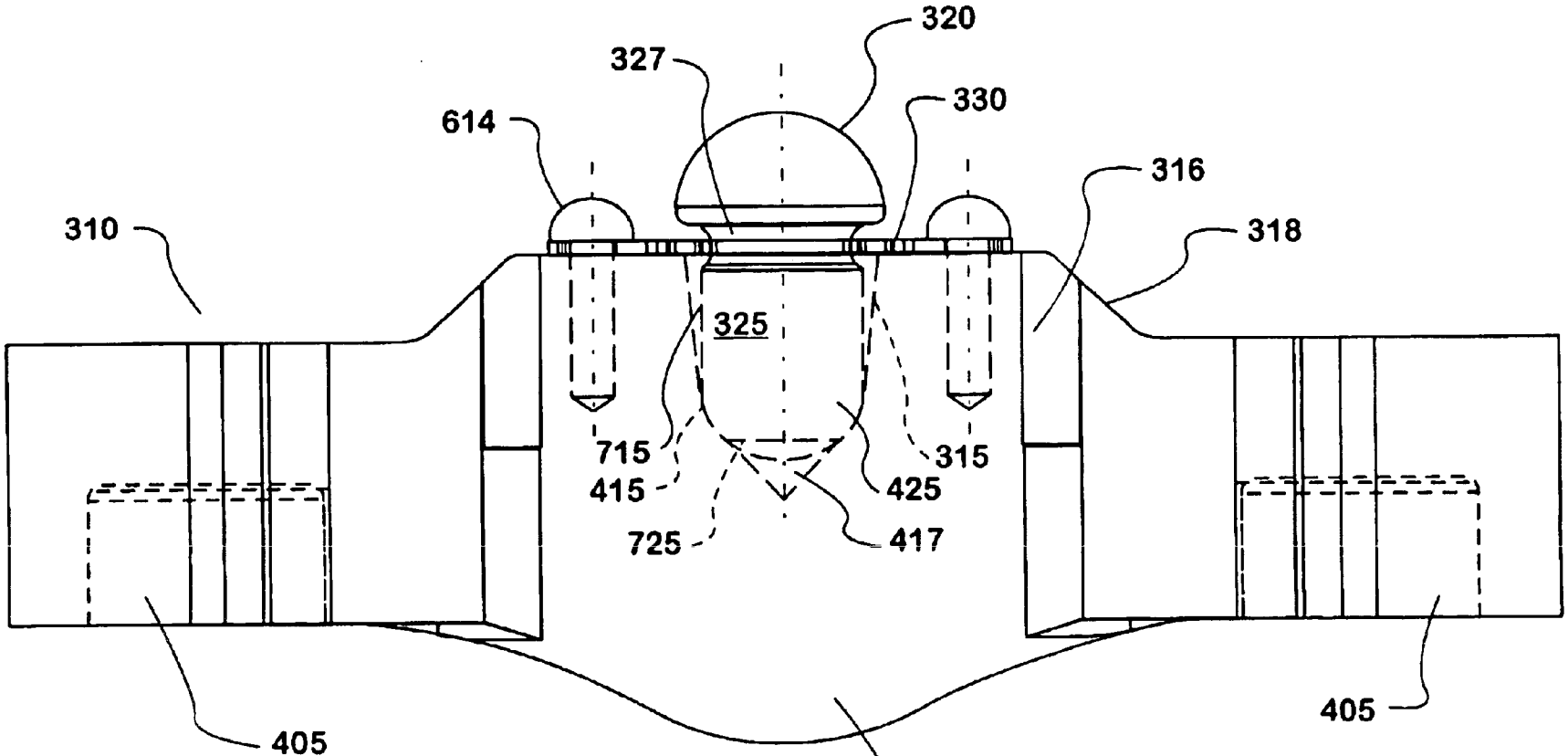
FIG. 7 shows a side view of the pivot rod and valve bridge of the valve actuation linkage mechanism of FIG. 6.

In a second case, the pivot rod retainer 330 is first secured to the valve bridge 310 by a pair of fasters 614 inserted into the valve bridge fastener bores 314(shown in FIGS. 6 & 7). The pivot rod 320 is next inserted into the pivot rod retainer 330 so that the pivot rod body 325 travels in the pivot rod retaining area 335. The resilient retaining prongs 337 flex or move to allow the pivot rod body 325 to travel in the pivot rod retaining area 335. Once the pivot rod body 325 has traveled sufficiently, the retaining prongs 337 will resiliently rebound or flex to secure the pivot rod 320, about the pivot rod neck 327, to the valve bridge 310 in the pivot rod chamber 315 (shown in FIGS. 6 & 7).

Once the pivot rod 320 has been secured to the valve bridge 310, the rocker arm 40 can interact or cooperate with the pivot rod 320/valve bridge 310 combination in the valve actuation linkage mechanism 300 to actuate corresponding valves (not shown). During operation of the valve actuation linkage mechanism 300, the pivot rod 320 will operate in a manner substantially similar to that of a push rod (not shown). The pivot rod 320 rotates freely and moves about the pivot rod head 329 and pivot rod bottom 425 (shown in FIG. 4) as necessary to account for the rotation and translation required for a 4-valve per cylinder engine requiring a valve bridge 310. There is enough play or space in the pivot rod retaining area 335 so that the pivot rod body 325 can move back and forth or vertically to translate the motion of the rocker arm 40 to the valve bridge 310 to appropriately actuate the valves (not shown) during engine operation.

Figure 4:
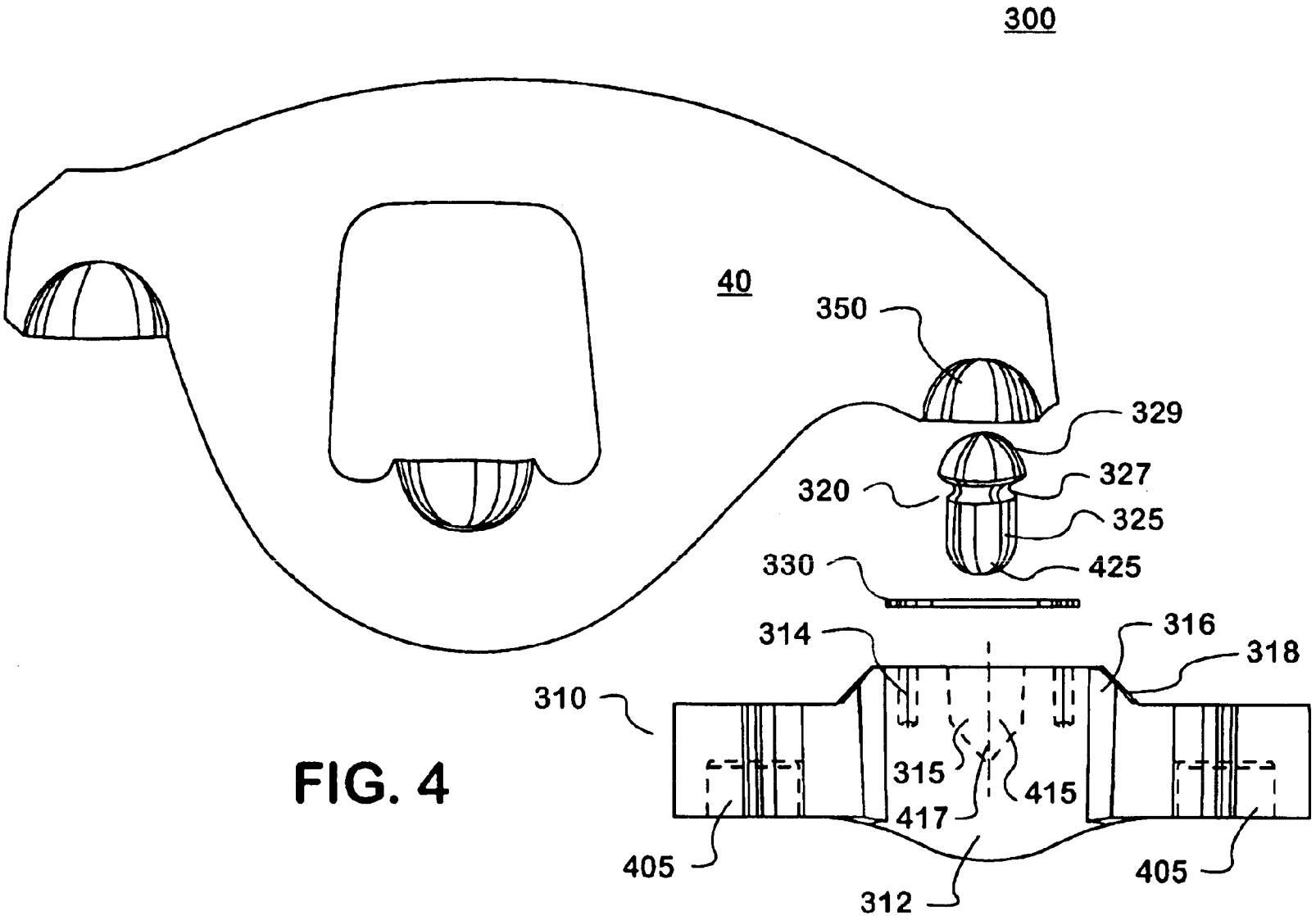
FIG. 4 shows a side view of the embodiment of a valve actuation linkage mechanism shown in FIG. 3.

FIG. 4 illustrates a side view of the valve actuation linkage mechanism 300 shown in FIG. 3. There is shown the rocker arm 40, the pivot rod 320, the pivot rod retainer 330, and the valve bridge 310. The pivot foot 320 comprising a pivot rod head 329, a pivot rod neck 327, and a pivot rod body 325 with a pivot rod bottom 425 is more clearly illustrated. Also shown is the pivot rod head 329 with the preferred curved shape in the form of a "mushroom" head.

FIG. 4 shows, in better detail, the valve bridge 310 comprising a pivot rod chamber 315, a pair of fastener bores 314, valve stem chambers 405, a bottom valve bridge section 312 and a middle valve bridge section 316. There is shown the pivot rod chamber 315 hollow cylindrical void or chamber configuration, which will complimentarily interact or cooperate with the pivot rod body 325. The complimentary configurations of the pivot rod bottom 425 and the corresponding pivot rod chamber bottom 415 will eliminate the flat surface rubbing contact 15 present in prior designs to substantially reduce friction wear between the pivot rod 320 and the valve bridge 310. Additionally, there is shown the divot or dimple 417 at the pivot chamber bottom 415 which will hold engine oil or some other lubricant to provide lubrication between the pivot rod 320 and the valve bridge 310. The lubrication between the pivot rod bottom 425 and the pivot chamber bottom 415 will further reduce friction wear between the pivot rod 320 and the valve bridge 310.

FIG. 4 also shows, the pivot rod chamber 315 preferably located in the middle valve bridge section 316. The middle valve bridge section 316 may be either a raised body portion as shown here or flush as illustrated in FIG. 1, depending on the particular engine application. The bottom valve bridge section 312 provides the valve bridge 310 added structural support and strength as there is now a pivot rod chamber 315 in the valve bridge 310. The bottom valve bridge section 312 is preferably a raised body portion that extends away and downward from the valve bridge 310. Also, shown are the fastener bores 314 typically bored into the valve bridge 310 adjacent to the pivot rod chamber 315. The fastener bores 314 allow the pivot rod 310 to be secured in the pivot rod chamber 315 via the pivot rod retainer 330 (shown in FIGS. 6 & 7). FIG. 4 also shows the preferred flat shape of the pivot rod retainer 330.

Figure 5:
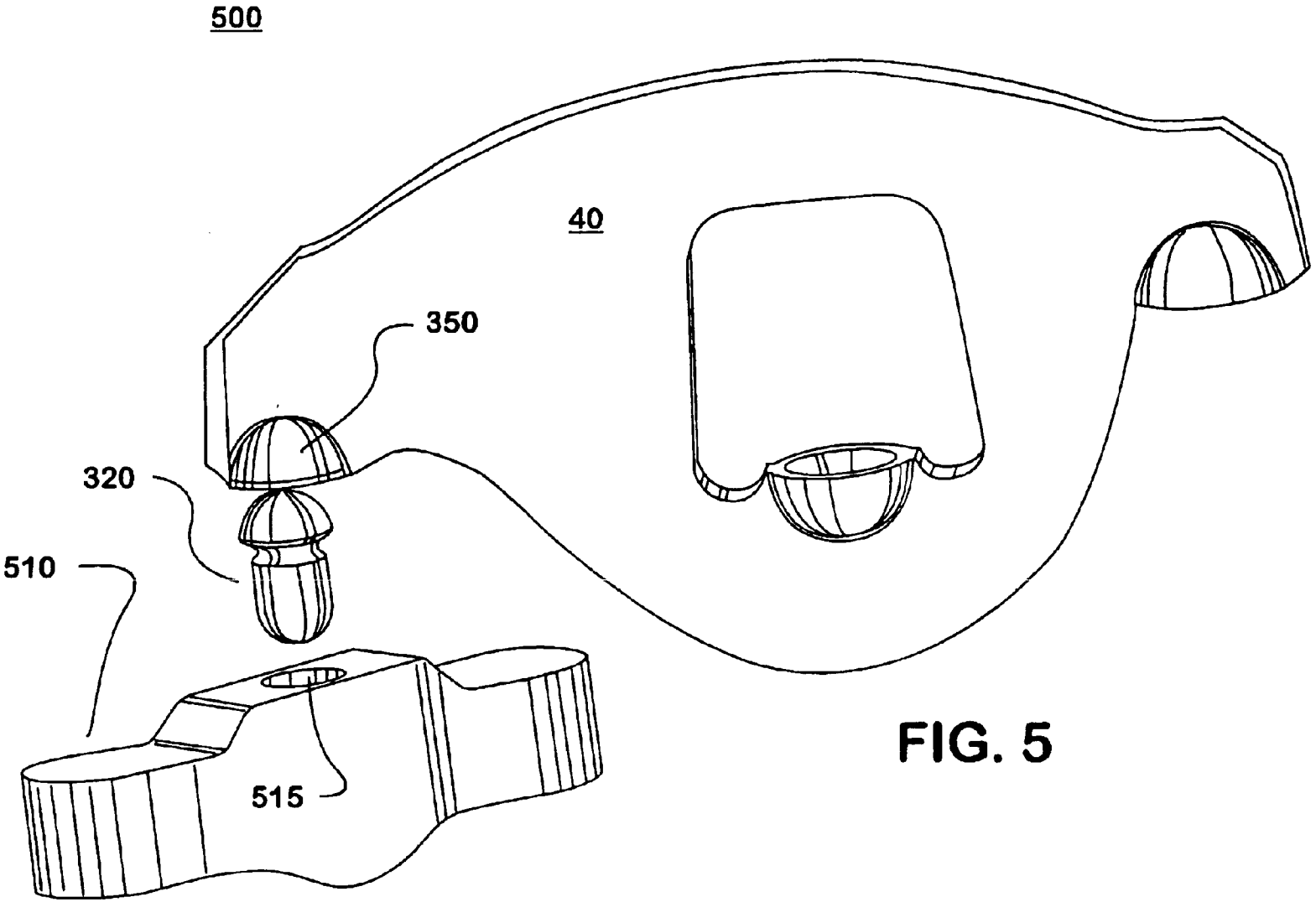
FIG. 5 shows a perspective view of another embodiment of the valve actuation linkage mechanism according to the present invention.

FIG. 5 illustrates a perspective view of a second embodiment of the valve actuation linkage mechanism 500 according to the present invention. The second embodiment of the valve actuation linkage mechanism 500 is identical to the first embodiment of the valve actuation linkage mechanism 500 shown in FIG. 1. There is one main exception, there is no use of the pivot rod retainer 330 (show in FIGS. 3 & 4). The valve actuation linkage mechanism 500 here is preferably held in proper positioning by the close tolerances between the rocker arm 40, the pivot rod 320 and the valve bridge 310 once the valve actuation linkage mechanism 500 is operationally installed in an engine using this embodiment.

The valve actuation linkage mechanism 500 will operate in a manner substantially similar to that described for the first embodiment of the valve actuation linkage mechanism 300(FIG. 3). Once the pivot rod 320 has been installed in the valve bridge 310, the rocker arm 40 will cooperate with the pivot rod 320/valve bridge 310 combination to actuate corresponding valves (not shown). The pivot rod 320 rotates freely and moves about the pivot rod head 329 and pivot rod bottom 425 (shown in FIG. 4) as necessary to account for the rotation and translation required for a 4-valve per cylinder engine requiring a valve bridge 310. There is enough play or space in the pivot rod chamber 315 so that the pivot rod body 325 can move back and forth to translate the motion of the rocker arm 40 to the valve bridge 310 to appropriately actuate the valves (not shown) during engine operation.

FIG. 6 shows a perspective view of a pivot rod 320 and valve bridge 310 of the valve actuation linkage mechanism 300 shown in FIG. 3. FIG. 6 shows the pivot rod 320 and pivot rod retainer 330 secured to the valve bridge 310 by a pair of fasteners 614 inserted into the valve bridge fastener bores 314. The resilient retaining prongs 337 are shown securing the pivot rod 320 about the pivot rod neck 327 to the valve bridge 310 in the pivot rod chamber 315 (shown in FIG. 7). Also, the pivot rod retainer 330 comprises a pivot rod retainer area 335 that is configured to allow the pivot rod 320 movement or play within the pivot rod area 335 during valve actuation. Once the pivot rod 320 has been secured to the valve bridge 310, the rocker arm 40 cooperates with the pivot rod 320/valve bridge 310 combination to actuate corresponding valves (not shown). The pivot rod body 325 will preferably move back and forth in the pivot rod chamber and vertically to translate the motion of the rocker arm 40 to the valve bridge 310 and thereby actuate the valves (not shown) during engine operation.

FIG. 7 shows a side view of a pivot rod 320 and valve bridge 310 of the partial valve actuation linkage mechanism 300 shown in FIG. 6. There is shown the pivot rod 320 appropriately positioned in the pivot rod chamber 315 and secured to the valve bridge 310 by the pivot rod retainer 330 by a pair of fasteners 614. The fasteners are preferably inserted into a pair of opposing the valve bridge fastener bores 314 located adjacent to the pivot rod chamber 315. The pivot rod retainer 330 is shown securing the pivot rod 320 about the pivot rod neck 327 to the valve bridge 310. Once the pivot rod 320 has been secured to the valve bridge 310, the rocker arm 40 cooperates with the pivot rod 320/valve bridge 310 combination to actuate corresponding valves (not shown).

FIG. 7 shows a pivot rod chamber movement area 715 that allows the pivot rod to move back and forth inside the pivot rod chamber 315 to compensate for the arc motion of the rocker arm 40 (shown in FIG. 3) during engine operation. In this manner the vertical motion of the rocker arm 40 can be translated to the valve bridge 310 during engine operation. There is also shown the complimentary round nature of the pivot rod bottom 425 and the pivot rod chamber bottom 415. The complimentary configurations of the pivot rod bottom 425 and the corresponding pivot rod chamber bottom 415 eliminate the flat surface rubbing contact 15 present in prior designs such as shown in FIG. 1. Instead of the flat surface contact area 15 (shown in FIG. 1), the complimentary curved surfaces of the pivot rod bottom 425 and the corresponding pivot rod chamber bottom 415 result in a contact line or contact line area 725 between both components. The resultant contact line area 725 is smaller than the flat surface rubbing contact 15 shown in FIG. 1 and thus substantially reduces friction wear between the pivot rod 320 and the valve bridge 310. Additionally, the pivot rod chamber 315 has a divot or dimple 417 at the pivot rod chamber bottom 415 which will hold engine oil or some other lubricant to provide lubrication between the pivot rod 320 and the valve bridge 310. The lubrication between the pivot rod bottom 425 and the pivot chamber bottom 415 further reduces friction wear between the pivot rod 320 and the valve bridge 310.

The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

I claim:

1. A valve actuation linkage mechanism for use in an internal combustion engine comprising:

a rocker arm having a pivot rod cup;

a valve bridge having a pivot rod chamber; and a pivot rod comprising a pivot rod head, wherein at least a part of the pivot rod head pivots within the pivot rod cup while retained by a pivot rod retainer, and comprising a pivot rod body, wherein at least a part of the pivot rod body pivots in the pivot rod chamber.

2. The valve actuation linkage mechanism of claim 1, wherein the pivot rod retainer retains the pivot rod to the valve bridge.

3. The valve actuation linkage mechanism of claim 2, wherein the pivot rod retainer comprises:

a pivot rod orifice having at least one pivot rod prong; and at least one securing orifice.

4. The valve actuation linkage mechanism of claim 2, wherein the valve bridge further comprises:

a middle valve bridge section having the pivot rod chamber and at least one adjacent pivot rod retainer securing bore; and a bottom valve bridge section.

5. The valve actuation linkage mechanism of claim 1, wherein the pivot rod chamber further comprises a lubricant dimple.

6. The valve actuation linkage mechanism of claim 2, wherein the pivot rod comprises:

a pivot rod head;

a pivot rod neck;

a pivot rod body; and a pivot rod bottom.

7. The valve actuation linkage mechanism of claim 1, wherein the pivot rod and pivot rod chamber cooperate to form a contact line.

8. A valve actuation linkage mechanism for use in an internal combustion engine comprising:

a rocker arm having a pivot rod cup;

a pivot rod;

a pivot rod retainer;

a valve bridge having a pivot rod chamber;

a middle valve bridge section having the pivot rod chamber and at least one adjacent pivot rod retainer securing bore; and a bottom valve bridge section.

9. The valve actuation linkage mechanism of claim 8, wherein the pivot rod retainer comprises:

a pivot rod orifice having at least one pivot rod prong; and at least one securing orifice.

10. The valve actuation linkage mechanism of claim 8, wherein the pivot rod comprises:

a pivot rod head;

a pivot rod neck;

a pivot rod body; and a pivot rod bottom.

11. The valve actuation linkage mechanism of claim 8, wherein the pivot rod chamber further comprises a lubricant dimple.

12. The valve actuation linkage mechanism of claim 8, wherein the pivot rod and pivot rod chamber cooperate to form a contact line.

13. A valve actuation linkage mechanism for use in an internal combustion engine comprising:

a pivot rod retainer;

a valve bridge having a pivot rod chamber; and a pivot rod comprising a pivot rod head, wherein at least a part of the pivot rod head is pivotable within a pivot rod cup of a rocker arm while retained by the pivot rod retainer, and comprising a pivot rod body, wherein at least a part of the pivot rod body pivots in the pivot rod chamber.

14. The valve actuation linkage mechanism of claim 13, wherein the pivot rod retainer comprises:

a pivot rod orifice having at least one pivot rod prong; and at least one securing orifice.

15. The valve actuation linkage mechanism of claim 13, wherein the valve bridge further comprises:

a middle valve bridge section having the pivot rod chamber and at least one adjacent pivot rod retainer securing bore; and a bottom valve bridge section.

16. The valve actuation linkage mechanism of claim 13, wherein the pivot rod chamber further comprises a lubricant dimple.

17. The valve actuation linkage mechanism of claim 13, wherein the pivot rod comprises:

a pivot rod head;

a pivot rod neck;

a pivot rod body; and a pivot rod bottom.

18. The valve actuation linkage mechanism of claim 13, wherein the pivot rod and pivot rod chamber cooperate to form a contact line.

19. The valve actuation linkage mechanism of claim 13, wherein the pivot rod retainer retains the pivot rod to the valve bridge.

20. The valve actuation linkage mechanism of claim 8, wherein the pivot rod retainer retains the pivot rod to the valve bridge.

* * * * *